US009844693B2

(12) United States Patent
Jones

(10) Patent No.: US 9,844,693 B2
(45) Date of Patent: Dec. 19, 2017

(54) GLOVE

(71) Applicant: PowerHandz Inc., Irving, TX (US)

(72) Inventor: Darnell Jones, Irving, TX (US)

(73) Assignee: POWERHANDZ INC, Irving, TX (US)

( * ) Notice: Subject to any disclaimer, the term of this patent is extended or adjusted under 35 U.S.C. 154(b) by 0 days.

(21) Appl. No.: 14/525,958

(22) Filed: Oct. 28, 2014

(65) Prior Publication Data

US 2015/0119200 A1 Apr. 30, 2015

Related U.S. Application Data

(60) Provisional application No. 61/896,572, filed on Oct. 28, 2013.

(51) Int. Cl.
*A63B 21/00* (2006.01)
*A63B 21/06* (2006.01)
(Continued)

(52) U.S. Cl.
CPC ..... *A63B 21/065* (2013.01); *A63B 21/0603* (2013.01); *A63B 21/0607* (2013.01);
(Continued)

(58) Field of Classification Search
CPC ..... A63B 21/0004; A63B 21/00061; A63B 21/00065; A63B 21/00076; A63B 21/012; A63B 21/06; A63B 21/0601; A63B 21/0603; A63B 21/0604; A63B 21/0607; A63B 21/065; A63B 21/068; A63B 21/4001; A63B 21/4019; A63B 21/4021; A63B 21/4023; A63B 21/4025; A63B 21/4039; A63B 21/4043; A63B 23/12; A63B 23/14; A63B 23/16; A63B 29/08; A63B 71/14; A63B 71/141; A63B 71/143; A63B 71/146; A63B 71/148; A41D 19/00; A41D 19/002; A41D 19/0024; A41D 19/0034; A41D 19/0037; A41D 19/01547; A41D 19/01558; A41D 19/01564
See application file for complete search history.

(56) References Cited

U.S. PATENT DOCUMENTS 3,838,853 A * 10/1974 Fredenhagen ..... G09B 15/06 2/161.1
3,934,290 A * 1/1976 Le Vasseur ..... A41D 7/00 2/2.15
(Continued)

*Primary Examiner* — Andrew S Lo
*Assistant Examiner* — Gary D Urbiel Goldner
(74) *Attorney, Agent, or Firm* — Jason P. Webb; Pearson Butler

(57) ABSTRACT

A glove including a dorsal panel having a finger region. The dorsal panel includes an array of four finger regions and each finger region having at least two weights coupled thereto in a longitudinally spaced relationship to each other. The dorsal panel includes a thumb region spaced and orientated away from the finger region. The thumb region includes a weight coupled thereto. The glove includes a weight coupled to the finger region of the dorsal panel. The weight includes a sealed pocket having heavy grains. The weight is not selectably removable. The glove includes a palmar panel coupled to the dorsal panel and thereby forming a cavity therebetween. The palmar panel includes a slick surface.

17 Claims, 7 Drawing Sheets

(51) Int. Cl.

| | |
|---|---|
| ***A63B 21/065*** | (2006.01) |
| *A63B 102/24* | (2015.01) |
| *A63B 102/32* | (2015.01) |
| *A63B 102/16* | (2015.01) |
| *A63B 102/02* | (2015.01) |
| *A63B 102/34* | (2015.01) |
| *A63B 102/18* | (2015.01) |

(52) U.S. Cl.

CPC ..... *A63B 21/4019* (2015.10); *A63B 2102/02* (2015.10); *A63B 2102/16* (2015.10); *A63B 2102/18* (2015.10); *A63B 2102/24* (2015.10); *A63B 2102/32* (2015.10); *A63B 2102/34* (2015.10); *A63B 2243/007* (2013.01); *A63B 2243/0037* (2013.01); *A63B 2244/10* (2013.01)

(56) References Cited

U.S. PATENT DOCUMENTS 4,055,174 A * 10/1977 LeVasseur ..... A41D 7/00 128/201.11
4,244,057 A * 1/1981 Burnham ..... A41D 19/0024 2/160
4,247,097 A 1/1981 Schwartz
4,253,660 A * 3/1981 Tiktin ..... A63B 21/065 2/160
4,368,883 A * 1/1983 Tiktin ..... A63B 21/065 2/162
4,684,123 A 8/1987 Fabry
4,738,447 A 4/1988 Brown
4,911,433 A 3/1990 Walker et al.
5,184,815 A * 2/1993 Maddox ..... A63B 69/0002 2/161.1
5,386,591 A * 2/1995 Canan ..... A63B 71/141 2/160
5,500,956 A * 3/1996 Schulkin ..... A63B 71/148 2/159
5,530,967 A 7/1996 Cielo
5,581,809 A * 12/1996 Mah ..... A41D 19/01523 2/161.1
5,683,335 A 11/1997 Groves et al.
5,704,883 A 1/1998 Eckmann
5,706,521 A * 1/1998 Haney ..... A41D 19/0037 2/160
5,768,710 A * 6/1998 Williams ..... A63B 21/065 2/160
5,802,615 A * 9/1998 Wenk ..... A63B 71/146 2/160
5,819,313 A * 10/1998 McCrane ..... A41D 13/088 2/16
5,829,057 A * 11/1998 Gunn ..... A41B 11/00 2/115
5,898,943 A * 5/1999 Kim ..... A63B 71/146 2/161.2
5,956,770 A * 9/1999 Dennis ..... A47L 13/18 15/227
6,006,357 A * 12/1999 Mead ..... A41D 19/0157 2/160
6,029,275 A * 2/2000 De Prado ..... A41D 19/00 2/159
6,049,910 A * 4/2000 McCarter ..... A63B 71/148 2/161.1
6,119,271 A 9/2000 Byon
6,279,163 B1 * 8/2001 Hale ..... A63B 21/065 2/160
6,553,574 B1 4/2003 Hall, Jr. et al.
6,561,958 B2 5/2003 Pappert
6,629,911 B2 10/2003 Cook
6,990,689 B1 1/2006 Thellmann
7,354,385 B2 4/2008 Virji et al.
7,856,670 B1 12/2010 Hazuga et al.
7,874,020 B1 * 1/2011 Franklin ..... A47L 13/18 15/229.11
7,908,672 B2 3/2011 Butler
8,132,269 B1 * 3/2012 Ibon ..... A41D 19/01523 2/161.1
8,312,567 B1 11/2012 Valle
2004/0010838 A1 * 1/2004 Wren ..... A41D 19/01558 2/158
2004/0031120 A1 * 2/2004 Cherian ..... A41D 19/0024 15/227
2004/0074036 A1 * 4/2004 Collier ..... A41D 19/01594 15/245
2005/0091729 A1 * 5/2005 Alley ..... A41B 11/004 2/239
2005/0229284 A1 * 10/2005 Gaetz ..... A41D 19/01594 2/159
2006/0248628 A1 * 11/2006 Hawkes ..... A41D 13/018 2/159
2006/0272072 A1 12/2006 Murphy
2007/0234466 A1 * 10/2007 Stengel ..... A41D 19/0024 2/160
2008/0263747 A1 * 10/2008 DeBlasis ..... A41F 1/06 2/161.1
2009/0255032 A1 10/2009 Pugh
2009/0288236 A1 * 11/2009 Hawkes ..... A41D 13/018 2/20
2011/0214221 A1 * 9/2011 Munda ..... A63B 71/14 2/161.1
2012/0100938 A1 * 4/2012 McKinley ..... A63B 21/0555 473/450
2012/0159681 A1 * 6/2012 Gibby ..... A41D 13/0156 2/20
2013/0007937 A1 * 1/2013 Stone ..... A41D 13/081 2/16
2013/0269076 A1 * 10/2013 Arnone ..... A41D 19/01523 2/20
2013/0269084 A1 * 10/2013 Ray ..... A41D 19/01547 2/163
2013/0281234 A1 * 10/2013 Ramirez ..... A41D 19/0013 473/415
2014/0143926 A1 * 5/2014 Brown ..... A63B 71/143 2/20
2014/0215685 A1 * 8/2014 Bush ..... A41D 19/01523 2/161.1
2014/0259258 A1 * 9/2014 Miranda ..... A63B 71/143 2/20

* cited by examiner

GLOVE

CROSS-REFERENCE TO RELATED APPLICATIONS

This invention claims priority, under 35 U.S.C. §120, to the U.S. Provisional Patent Application No. 61/896,572 to Darnell Jones filed on Oct. 28, 2013, which is incorporated by reference herein in its entirety.

BACKGROUND OF THE INVENTION

Field of the Invention

The present invention relates to athletic training devices, specifically to a weighted athletic training glove.

Description of the Related Art

Sports-specific training involves developing physical characteristics, such as strength, flexibility, stamina and coordination, to improve an athletes performance and skills at a particular sport. Examples include increasing arm strength for tennis of baseball, or improving strength and core stability for better balance playing golf. Other examples include improving hand-eye coordination for catching passes in football, or dribbling and catching a basketball.

Some improvements have been made in the field. Examples of references related to the present invention are described below in their own words, and the supporting teachings of each reference are incorporated by reference herein:

U.S. Pat. No. 4,684,123, issued to Fabry, discloses a weighted exercise garment, particularly a glove having one or more elastic pockets on the outside thereof on a back portion of the glove which covers the back of the hand. One or more weights are inserted into the elastic pockets in order to change the total weight of the exercise glove, and can be secured in the pockets. A further aspect of the present invention relates to an exercise garment having a unique closure utilizing releasable contact fasteners, which closure functions to secure the weights in the pockets and secure the garment to the wearer's body. In a preferred embodiment, a row of pockets is employed, and the closure is used to simultaneously open or close all of the pockets. The invention is advantageous in that it allows the wearer to conveniently change the amount of weight carried in the exercise garment.

U.S. Pat. No. 7,354,385, issued to Virji et al., discloses various systems, methods, devices, etc. for simulating obesity and enhancing caloric expenditure in daily activities are provided. One embodiment is a device for wearing over a body joint to simulate obesity and enhance caloric expenditure in daily activities. One such device comprises a distally/proximally-weighted sleeve joint.

U.S. Pat. No. 7,908,672, issued to Butler, discloses a glove includes a glove body including opposing dorsal and palmar side panels, opposing proximal and distal ends, a wrist portion formed in the proximal end, and finger stalls formed in the distal end. An elongate strap has an inner end secured to the wrist portion of the glove body and an opposed free outer end, and a plurality of weight-receiving pockets formed in the elongate strap between the inner end of the elongate strap and the outer end of the elongate strap. Corresponding engagement and complemental engagement elements are carried by the elongate strap. The elongate strap is movable between a first position extending away from the wrist portion and a second position wrapped about the wrist portion engaging the engagement element to the complemental engagement element securing the elongate strap in the second position.

U.S. Patent Application Publication No.: 2006/0272072, by Murphy, discloses an article of manufacture, more specifically, a basketball training glove, with a primary element that is a physical aid to train and reinforce proper ball handling technique, such as an element in the palm of the glove that makes it impossible for a ball handler to palm a basketball, enforcing the use of the finger tips for proper ball control, and another primary element of the glove with optional weights for resistance training for the purpose of building power and speed into the hands, wrists, and arms, the advantage of the current invention being that it provides for fingertip ball control and weight resistance training at the same time and incorporates both features into one pair of basketball training gloves.

The inventions heretofore known suffer from a number of disadvantages which include one or more of, but not limited to, being limited in use, being limited in application, being too bulky, being difficult to use, being limited in flexibility, being limited in athletic training, failing to strengthen grip, damaging furniture, not being safe, not increasing skill in gripping sports objects, strengthening only the wrist, being expensive, being inconvenient, and being difficult to apply or use.

What is needed is a glove that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available athletic training gloves. Accordingly, the present invention has been developed to provide a weighted athletic training glove.

According to one embodiment of the invention, there is a glove that may include a dorsal panel that may have a finger region. The dorsal panel may include an array of four finger regions and each finger region may have at least two weights coupled thereto in a longitudinally spaced relationship to each other. The dorsal panel may include a thumb region that may be spaced and orientated away from the finger region. The thumb region may include a weight that may be coupled thereto.

The glove may include a weight that may be coupled to the finger region of the dorsal panel. The weight may include a sealed pocket that may have heavy grains. The weight may not be selectably removable.

The glove may include a palmar panel that may be coupled to the dorsal panel and may thereby form a cavity therebetween. The palmar panel may include a slick surface. The slick exterior surface may have a coefficient of friction smaller than about 80% of the coefficient of friction of wet hands. The glove may include a weighted sleeve that may be extending proximally from a proximal end of the combined dorsal and palmar panels.

According to one embodiment of the invention, there is a method of improving physical characteristics of an athlete using a glove, such that one or more of the glove embodiments described herein. The method may include the step of providing a glove that may include a dorsal panel that may have a finger region. The glove may include a weight that may be coupled to the finger region of the dorsal panel. The glove may include a palmar panel that may be coupled to the dorsal panel and thereby forming a cavity therebetween.

The method may include the step of performing an athletic exercise while wearing the glove, thereby improving one or more physical characteristics of the athlete. The method may include the step of providing a slick surface to the palmar panel of the glove.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
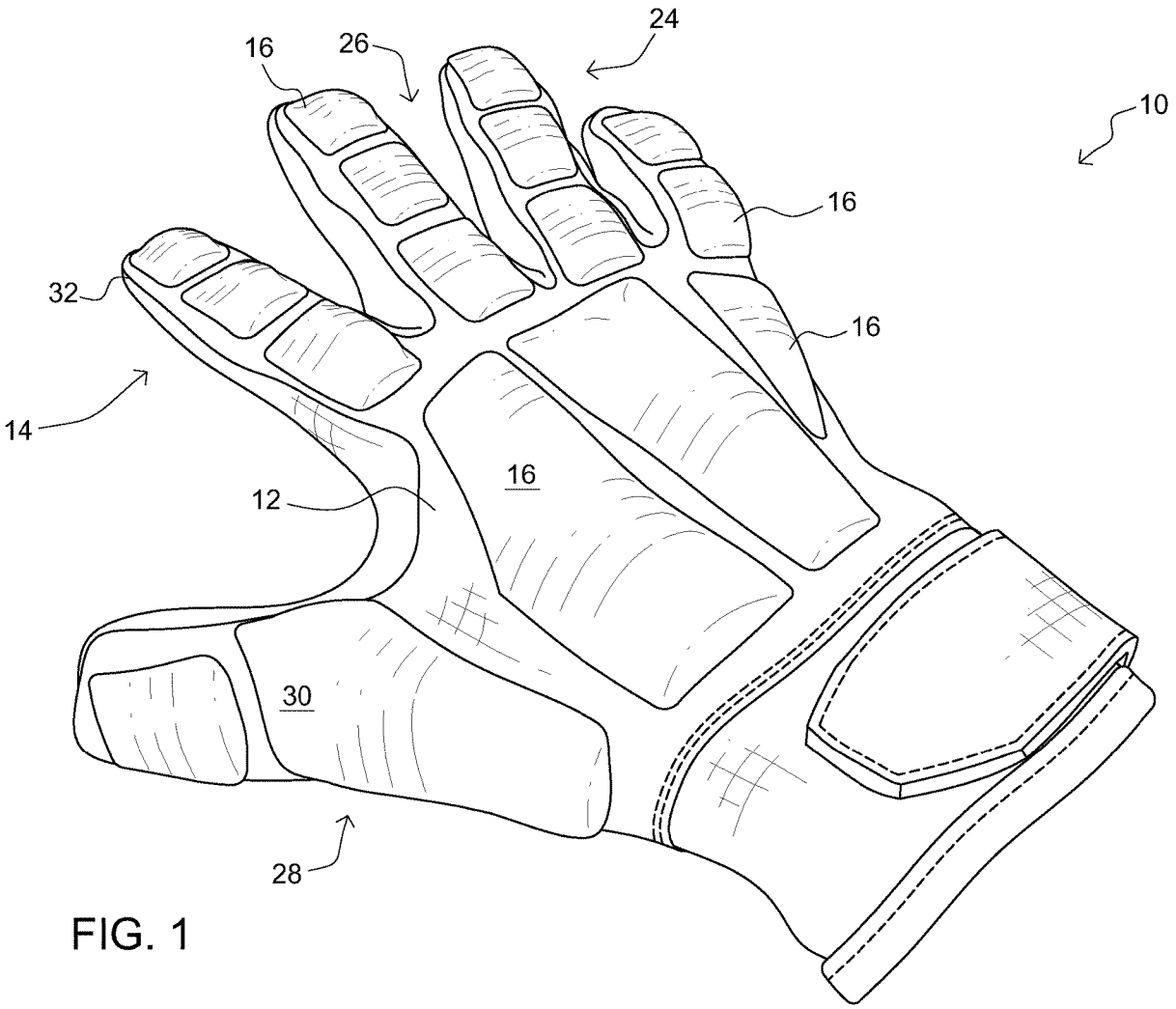
FIG. 1 is a top perspective view of a glove, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a top perspective view of a glove, according to one embodiment of the invention. There is shown a glove 10 including a dorsal panel 12 having a plurality of weights 16 coupled thereto. The dorsal panel may include a plurality of regions, sections, or the like that may be coupled to each other such as but not limited to by stitching. Advantageously, the illustrated glove provides targeted resistance to hand motion during the use of the hands, such as but not limited to during sporting and sports training activities. As the hand is particularly articulate, this targeted resistance provides strength, endurance, and resistance training to the various parts of the hand and related musculature.

The dorsal panel extends over a back of a hand of a user when the glove is worn on the hand of the user. The illustrated dorsal panel 12 includes sixteen weights disposed thereon. There are three weights disposed over each of the first three finger regions (pointer, middle, and ring); two weights disposed over the fourth finger (pinky) region; three weights disposed over the metacarpal region; and two weights disposed over the thumb region. The weights are fixedly coupled to the dorsal panel such that they retain their respective positions on the dorsal panel during operation, though the dorsal panel may be flexible and/or elastic in order to permit free movement of the hand, albeit resisted by the weights thereon.

Weights are collections of dense materials that do not provide structural support to the dorsal panel. Typically such will include metals (e.g. iron, lead) as they are plentiful and are dense and may be present in the form of grains (i.e. heavy grains), which are collections of granular material, similar to sand. Such weights are advantageously collectively flexible and may, when trapped in a pocket, change shape/form under stress. Thus, when dropped or banged against an object the trapped grains are likely to shift out of the way instead of cutting through/into the pocket material. Weights may include heavy plastics, ceramics, rubbers, polymers, and/or composite materials and the like and combinations thereof. Generally, the shape, size, density, and weight of the weights may be configured to desired characteristics so that the glove will have the resistance desired for particular types of training. Weights may be replaceable or may be permanently fixed within their pockets or otherwise coupled to the dorsal panel.

Individually, the weights 16 may be at least about 10 grams, or at least about 20 grams, or at least about 50 grams, and up to about 100 grams, or up to about 150 grams, or up to about 200 grams Collectively, the glove 10, with weights 16 attached, may weigh at least about 100 grams, or at least about 200 grams, or at least about 300 grams, and up to about 700 grams, or up to about 800 grams, or up to about 900 grams, or up to about 1000 grams. Alternatively, the weights 16 may be attached to an inner surface of the finger region.

The illustrated glove 10 is configured to provide training resistance while performing athletic exercises to increase athletic ability and characteristics. The glove 10 includes a dorsal panel 12 having a finger region 14 for receiving fingers of a hand. The illustrated finger region includes four finger tubes into which fingers of a user may be disposed during operation of the glove. The finger region includes a plurality of weights disposed therein on the backside of where the fingers will be placed so that resistance is applied to manipulation of the fingers without getting in the way of the operation of the fingers in gripping objects such as but not limited to sporting equipment/accessories (e.g. balls, bats, sticks, brooms, guns, bows, pucks).

The glove 10 includes a plurality of weights 16 coupled to the finger region 12 of the dorsal panel 12. The weights are disposed about an exterior top surface of the dorsal panel, thereby applying weight downwardly on top of the hand of the user. The illustrated weights 16 include a plurality of sealed pockets 32 having heavy grains (e.g. lead sand) disposed therein. The illustrated weights 16 are not selectably removable from the sealed pocket 32, though in one non-limiting embodiment, one or more of such pockets may be selectably sealable thus permitting one to add/remove weight therefrom.

The dorsal panel 12 includes an array of four finger regions 24 and each finger region having at least two weights 16 coupled thereto in a longitudinally spaced relationship 26 to each other such that the weights are lined in a spaced array along the length of each of the finger regions. It is beneficial to position, space and size the weights so that weights to not reside directly on the joints of fingers of a typical hand when such a hand is disposed therein.

The illustrated dorsal panel 12 includes a thumb region 28 spaced and orientated away from the finger region 14, like a typical glove. The thumb region 28 also includes a weight 30 coupled thereto, thereby applying downward pressure onto the thumb. The thumb region is shaped and positioned to receive a thumb of a user when the glove is placed on the hand. The weights disposed on the thumb region are positioned to be at a backside of the thumb during operation. Accordingly, they do not rest in the same plane as the finger and metacarpal weights since the thumb of a typical user is rotated with respect to the rotational position of the fingers of the typical person.

Advantageously, a user may place one or more gloves on their hand(s) and then gain benefit therefrom during practice and/or training of sporting activities, such as but not limited to basketball, football, hockey, martial arts, golf, polo, tennis, Ping-Pong, baseball, and the like and even non-sport activities that require use of the hands, such as but not limited to conducting music, manual labor, construction, knitting, painting, and the like. During such practice, the hand, fingers, thumb, wrist, forearms and parts thereof are exercised and subject to increased resistance. Various exercises may be performed to increase the strength, endurance, speed, muscle memory, and/or accuracy of the hand, fingers, thumb, wrist, forearms and parts thereof.

Figure 2:
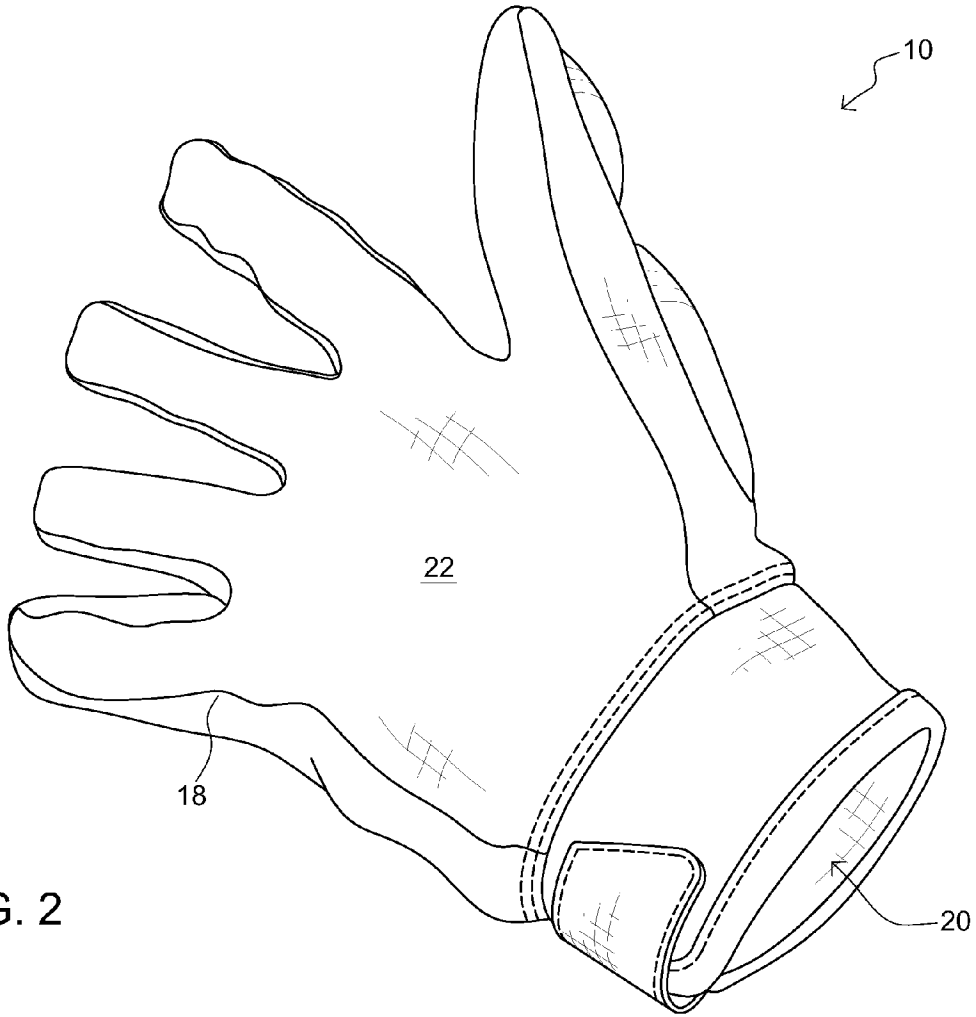
FIG. 2 is a bottom perspective view of a glove, according to one embodiment of the invention.

FIG. 2 is a bottom perspective view of a glove, according to one embodiment of the invention. There is shown a glove 10 including a palmar panel 18 including a slick surface 22. The slick palmar surface makes gripping objects with the hand(s) more difficult and prevents the user of such gloves from relying on friction from the palms of their hands to secure objects gripped therein. This structure alters the manner in which a user may handle such objects and increases their grip strength and skill in handling objects so that at a later time when the gloves are not used, gripping and handling such objects is easier and more likely to be effective. Such is very advantageous in sports, such as but not limited to football, basketball, and the like where how well the ball/object is handled by the player plays a major role in the outcome of a game.

The illustrated glove 10 includes a palmar panel 18 coupled to a dorsal panel of the glove 10. The palmar panel 18 and the dorsal panel couple together to form a cavity 20 therebetween. The cavity 20 is configured to receive a hand of a user. The glove 10 also includes a securement strap configured to wrap about the wrist of the user, thereby securing the glove to the hand of the user. The palm portion of a hand is disposed adjacent the palmar panel 18 and the fingers and thumb of the hand extends into the dorsal panel and the finger region and thumb region. The illustrated palmar panel 18 includes a slick surface 22. The slick exterior surface 22 includes a coefficient of friction smaller than about 80% of the coefficient of friction of wet hands. The slick surface 22 is configured to provide a slick surface, so that when training, a user has a more difficult time grasping items or performing an athletic function.

Friction is commonly measured by using a "coefficient of friction" which is a ratio of two masses (or forces) and therefore without units. The ratio is dead weight (or normal force) of an object and the break-away mass (or force) at which the object will begin to move across a surface. Studies on coefficient of friction have shown that soapy hands produced the lowest mean coefficients (0.46+/−0.04), significantly less then dry (1.72+/−0.16, $p<0.001$) and wet hands (1.42+/−0.16, $p<0.001$). The use of a functional test that incorporates an indirect determination of normal handgrip force has provided a quantitative method of observing stability at the hand/handle interface. The slick surface 22 may include a material that has a lower coefficient of friction than that of dry hands, wet hands, and/or about the coefficient of friction of soapy/wet hands. Materials which may be used include but are not limited to smooth woven plastics (e.g. nylon), tufted fabrics (e.g. velvet), smooth planar plastics, chiffon, silk, woven microfiber, satin, TEF- LON brand material (i.e. polytetrafluoroethylene)coated fabrics, and the like and combinations thereof. In one non-limiting embodiment, there is a slick surface on a palmar region of a glove having a coefficient of friction that is less than 1.5, 1.4, 1.3, 1.2, 1.1, 1.0, 0.9, 0.8, 0.7, 0.6, 0.5, 0.4, 0.3, 0.2, and/or 0.1.

A coefficient of friction ("COF") is a ratio of the friction force between two bodies and the force pressing them together. More specifically, coefficient of kinetic friction, $\mu_k$, may be used for surfaces in relative motion. The COF depends on the materials in contact with one another (e.g., the slick surface in contact with a leather skin of a football or basketball). As used herein, the COF may define interaction between the slick surface in contact with an exterior surface of a sporting ball (e.g., basketball, football, etc.). In certain embodiments, a COF between the slick surface and exterior ball surface may be less than 1.0. In certain embodiments, a COF between the palm surface 112 and exterior ball surface may be less than 0.8, or less than 0.6, or less than 0.4, or less than 0.2.

For example, the slick surface may be covered in materials including, but not limited to, fake fur, suede, velvet, fleece, cotton, mesh, polyester, Lycra®, nylon, and any other materials.

According to one embodiment of the invention, the illustrated glove 10 includes a tacky surface coupled a palmar panel 18 of the glove 10. The tacky surface includes a coefficient of friction greater than that of a coefficient of friction of a normal hand surface.

Figure 3:
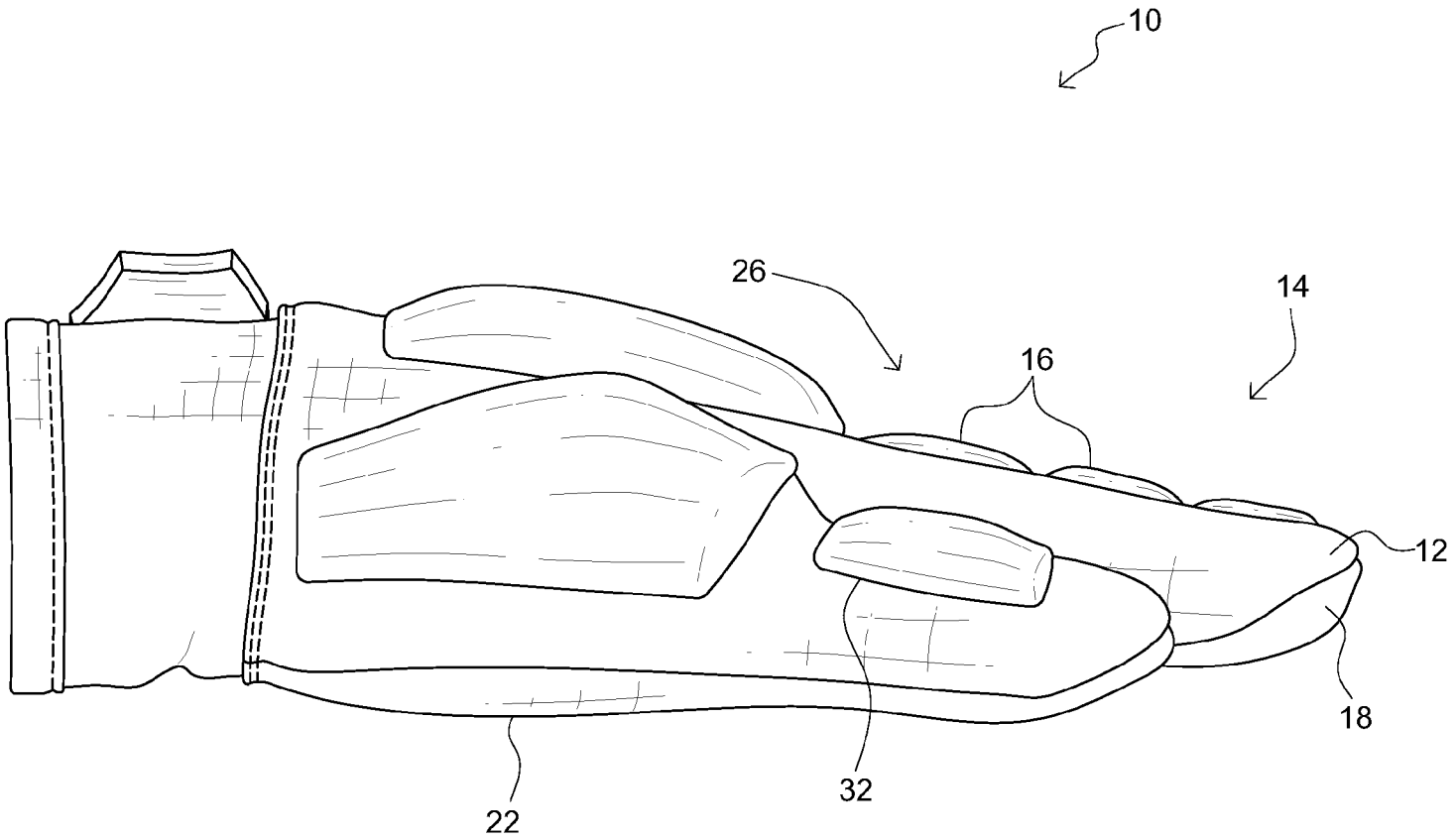
FIG. 3 is a side elevational view of a glove, according to one embodiment of the invention.

According to one embodiment of the invention, the illustrated glove 10 includes a palmar panel 18 including a fabric surface having a coefficient of friction about the same as a coefficient of friction of a normal hand surface, FIG. 3 is a side elevational view of a glove, according to one embodiment of the invention. There is shown a glove 10 including a dorsal panel 12 and a palmar panel 18.

The illustrated glove 10 is used during athletic training exercises to increase athletic characteristics of an athlete. The glove 10 includes a dorsal panel 12 having a finger region 14. The finger region 14 includes at least two weights 16 coupled thereto in a longitudinally spaced relationship 26 to each other. The weight 16 includes a sealed pocket 32 having heavy grains disposed therein. The weight 16 includes heavy grains instead of solid weights to protect the fingers or hand from damage or injury while performing athletic exercises. Solid weights do not have any flexibility or ability to move about the glove, in addition to being completely solid. The heavy grains are able to move about the sealed pocket 32, thereby providing additional flexibility and mobility while performing athletic exercises. The illustrated weight 16 is not selectably removable.

The illustrated glove 10 includes a palmar panel 18 coupled to the dorsal panel 12. The palmar panel 18 includes a slick surface 22. The slick exterior surface 22 may have a coefficient of friction smaller than about (i.e. plus or minus 5%) 80% of the coefficient of friction of wet hands. The slick exterior surface 22 is configured to increase finger strength while performing athletic exercises. An athlete will have to open and close their hands faster and stronger to catch an athletic ball, such as a football or basketball, while wearing the glove 10 because the weights 16 and the slick surface 22 make is much more difficult to catch and control the athletic ball.

Figure 4:
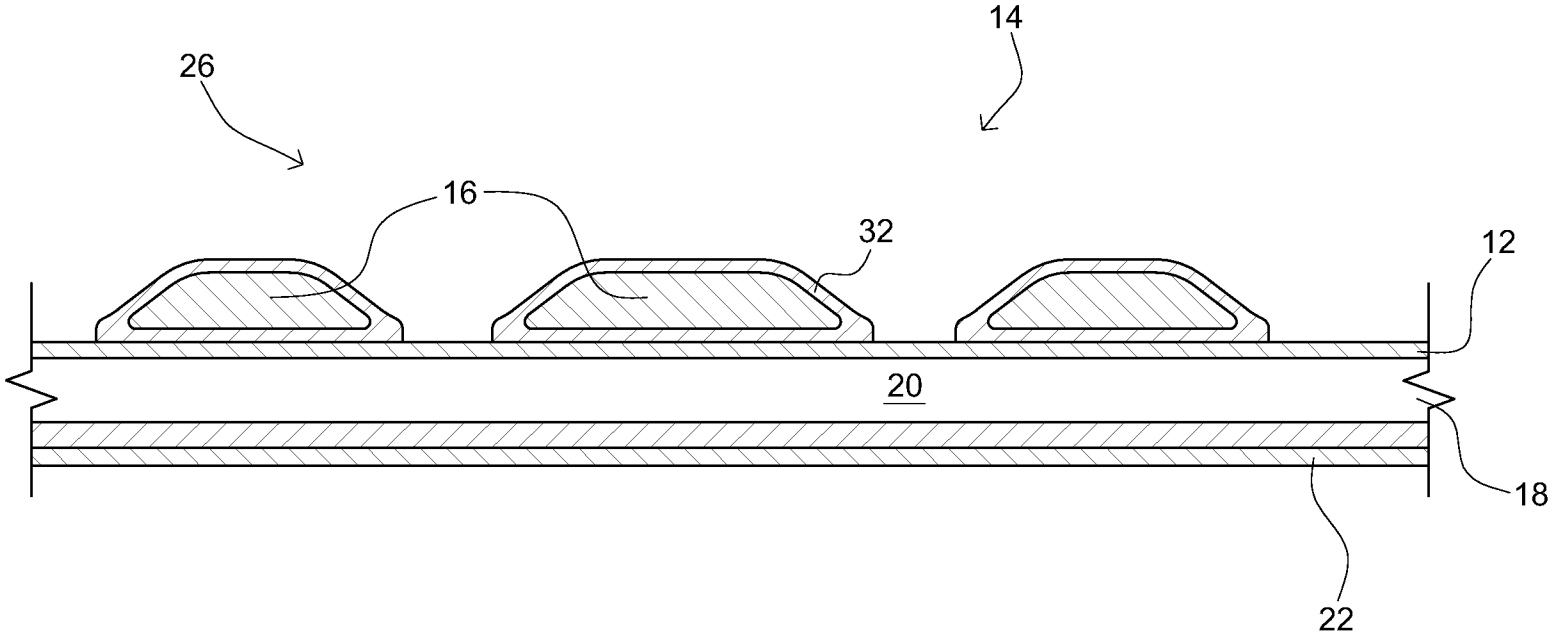
FIG. 4 is a cross-sectional view of a finger region of a glove, according to one embodiment of the invention.

FIG. 4 is a cross-sectional view of a finger region of a glove, according to one embodiment of the invention. There is shown a finger region 14 of a glove including weights 16 coupled thereto.

The illustrated finger region 14 is part of a dorsal panel 12 of a glove configured to receive fingers of a hand of a user. The finger region 14 includes a weight 16 coupled to the finger region 14 of the dorsal panel 12. The finger region 14 includes at least two weights 16 coupled thereto in a longitudinally spaced relationship 26 to each other. The weights 16 are disposed about a top surface of the finger region 14, wherein the weights 16 are disposed on top of metacarpals and phalanges of a hand to provide resistance to hand or finger movements. The weights 16 are not disposed above joints or knuckles of the hand, thereby allowing the hand to move freely while wearing the athletic training glove 10 and performing athletic exercises. The weight 16 includes a sealed pocket 32 having heavy grains disposed therein. The illustrated weight 16 is not selectably removable. The finger region 14 includes a palmar panel 18 coupled to the dorsal panel 12 and thereby forming a cavity 20 therebetween. The cavity 20 is configured to receive a hand of a user. The palmar panel 18 includes a slick surface 22. The slick exterior surface 22 includes a coefficient of friction smaller than about 80% of the coefficient of friction of wet hands.

Figure 5:
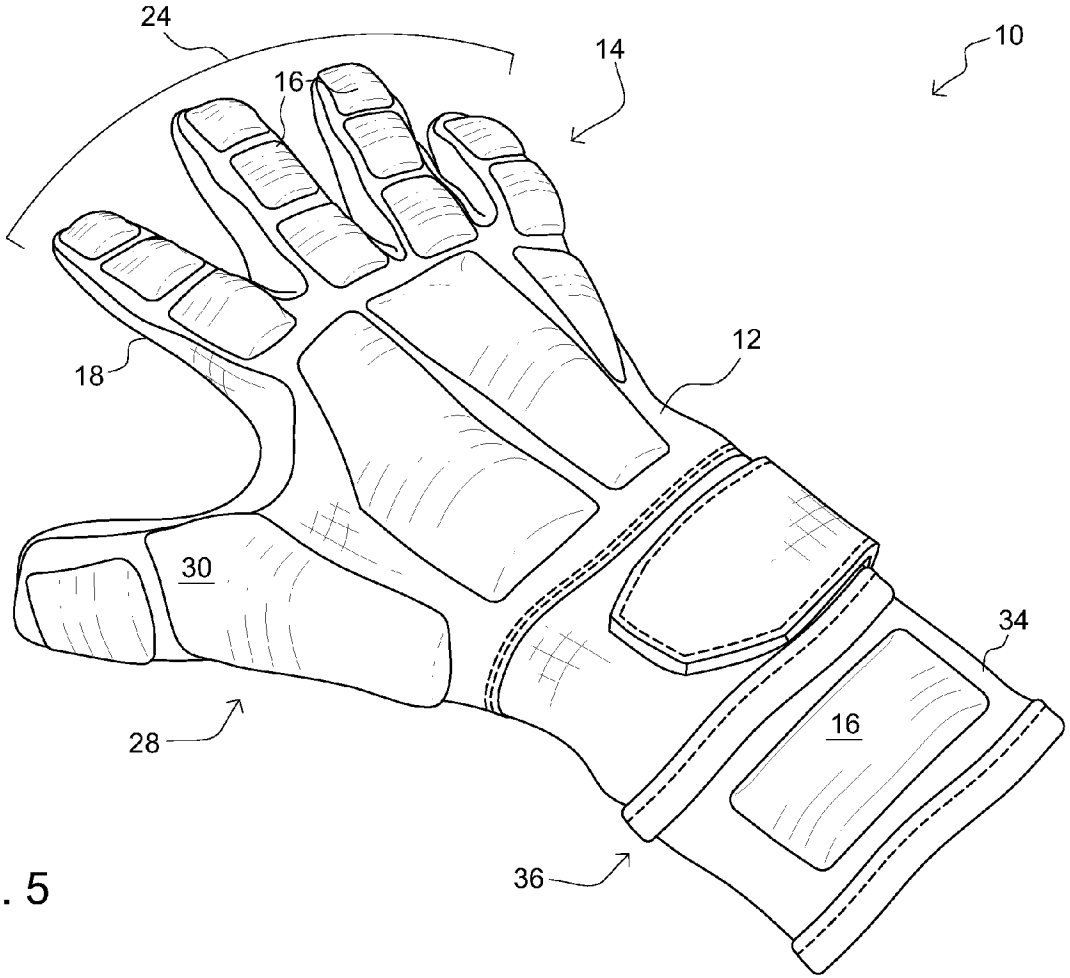
FIG. 5 is a top perspective view of a glove, according to one embodiment of the invention.

FIG. 5 is a top perspective view of a glove, according to one embodiment of the invention. There is shown a glove 10 including a dorsal panel 12 and a palmar panel 18 coupled to a weighted sleeve 34.

The illustrated glove 10 includes a dorsal panel 12 having a finger region 14. The dorsal panel 12 includes an array of four finger regions 24 and each finger region having at least two weights 16 coupled thereto in a longitudinally spaced relationship to each other. The dorsal panel 12 includes a thumb region 28 spaced and orientated away from the finger region. The thumb region 28 includes a weight 30 coupled thereto.

The illustrated glove 10 includes a palmar panel 18 coupled to the dorsal panel 12 and thereby forming a cavity therebetween for a hand of a user to be disposed therein. The palmar panel 18 includes a slick surface. The illustrated glove 10 includes a weighted sleeve 34 extending proximally from a proximal end 36 of the combined dorsal panel 12 and palmar panel 18. The illustrated weighted sleeve 34 may be an attachment that is selectably removable from the glove 10. The weighted sleeve 34 is designed to apply weighted resistance to the movement of a wrist of a user, thereby enhancing the athletic characteristic of an athlete while performing an athletic movement.

According to one embodiment of the invention, there is a weighted sleeve 34 that may be attached to the glove 10, or may be a separate piece. The weighted sleeve 34 may be configured to extend circumferentially around the wearer's wrist, either fully or partially. In certain embodiments, the weighted sleeve 34 may extend up the forearm a certain length (e.g., 3 inches, 6 inches, 12 inches). The weighted sleeve 34 may include one or more weights attached thereto. Weights may be at least about 0.5 lbs., or at least about 1 lb., or at least about 2 lbs., and up to about 3 lbs., or up to about 4 lbs., or up to about 5 lbs.

Figure 6:
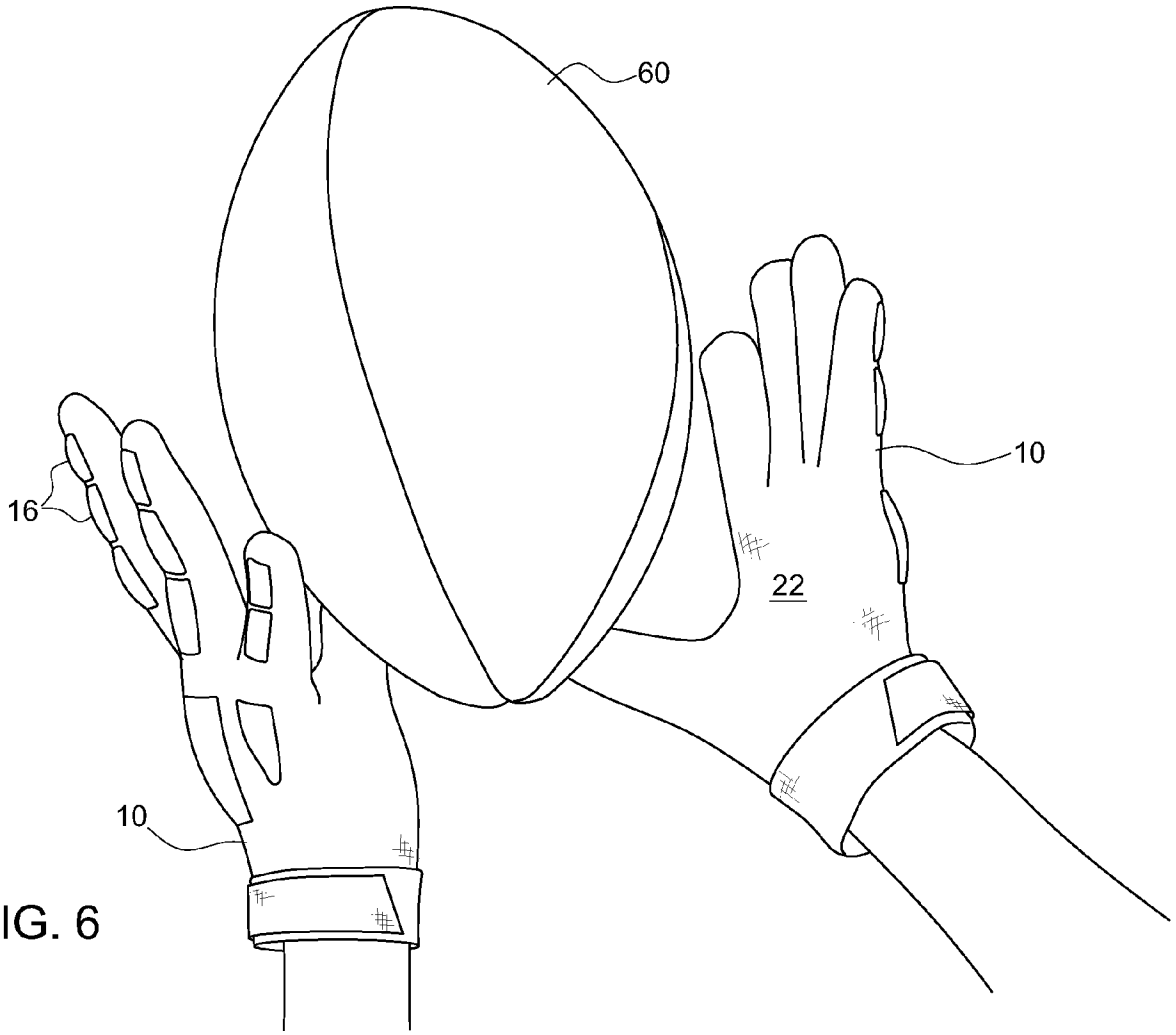
FIG. 6 is a perspective view of an athlete wearing a glove and performing an athletic exercise, according to one embodiment of the invention.

FIG. 6 is a perspective view of an athlete wearing a glove and performing an athletic exercise, according to one embodiment of the invention. There is shown a user wearing a glove 10 and performing an athletic exercise.

The illustrated gloves 10 are disposed over both hands of an athlete while performing an athletic exercise. The illustrated athletic exercise is catching an athletic ball, such as a football 60. The glove 10 includes a slick surface 22 disposed about a palmar panel 18, wherein the slick surface 22 makes it more difficult to catch the football 60, because the slick surface 22 had a smaller coefficient of friction smaller than about 80% of the coefficient of friction of wet hands, it makes performing the athletic exercise more difficult. The continuous use of the glove 10 while performing an athletic exercise increases the athlete's athletic characteristics, and thereby improving the athlete's abilities.

Figure 7:
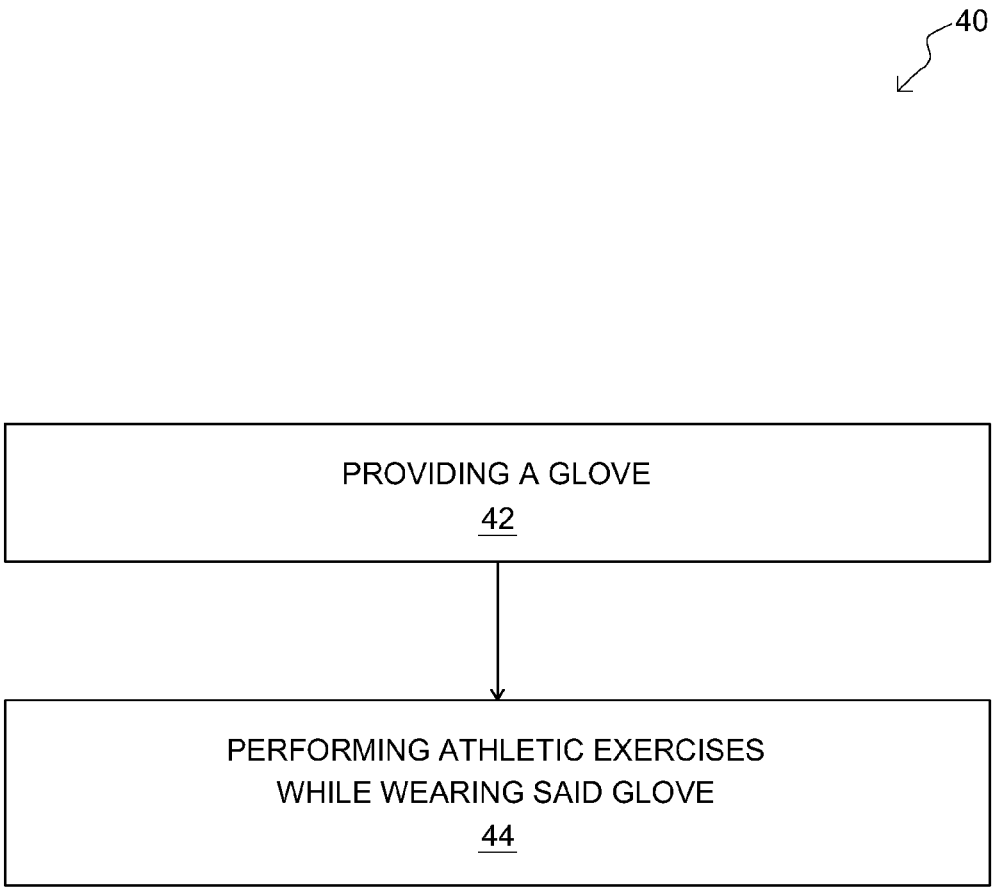
FIG. 7 is a flowchart of a method of improving physical characteristics of an athlete, according to one embodiment of the invention.

FIG. 7 is a flowchart of a method of improving physical characteristics of an athlete, according to one embodiment of the invention. There is shown a method of improving physical characteristics of an athlete using a glove 40.

The illustrated method of improving physical characteristics of an athlete using a glove 40 includes the step of providing a glove 42. The glove includes a dorsal panel having a finger region. The glove includes a weight coupled to the finger region of the dorsal panel. The glove also includes a palmar panel coupled to the dorsal panel and thereby forming a cavity therebetween for a hand to extend and rest therein. The glove includes a slick surface disposed on the palmar panel of the glove, thereby making it more difficult to perform athletic exercises.

The method of improving physical characteristics of an athlete using a glove 40 includes the step of performing an athletic exercise while wearing the glove, thereby improving one or more physical characteristics of the athlete 44.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the figures illustrate exact placement and orientation of a plurality of weights, but the various placements and orientations that may be constructed are plethoric.

Additionally, although the figures illustrate a glove having a specific number of weights thereon, it is contemplated that gloves may have more or fewer weights thereon than that illustrated.

It is also envisioned that there may be a kit including a plurality of gloves that have a variety of weight and slickness characteristics that may be used in a progressive training regimen wherein the user practices/trains with gloves having progressively higher weights and/or progressively slicker surfaces.

It is expected that there could be numerous variations of the design of this invention.

Finally, it is envisioned that the components of the device may be constructed of a variety of materials, including but not limited to plastics, metals, ceramics, polymers, rubbers, gels, dense non-metals, and the like and combinations thereof.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A glove, comprising:

a) a dorsal panel having a finger region;

b) a weight coupled to the finger region of the dorsal panel; and c) a palmar panel coupled to the dorsal panel and thereby forming a cavity therebetween, wherein the palmar panel includes a slick exterior surface, wherein the palmar panel includes a palmar array of four finger regions and the slick exterior surface extends along the palmar array of four finger regions of the palmar panel.

2. The glove of claim 1, wherein the finger region of the dorsal panel includes an array of four finger regions and the array of four finger regions has at least two weights coupled to each thereto in a longitudinally spaced relationship to each other.

3. The glove of claim 1, wherein the dorsal panel further includes: a thumb region spaced and orientated away from the finger region; and a weight coupled to the thumb region.

4. The glove of claim 1, wherein the weight includes a sealed pocket including heavy grains.

5. The glove of claim 1, wherein the weight is not selectably removable.

6. The glove of claim 1, wherein the slick exterior surface has a coefficient of friction smaller than about 80% of the coefficient of friction of wet hands.

7. The glove of claim 1, further comprising a weighted sleeve extending proximally from a proximal end of the combined dorsal and palmar panels.

8. A glove, comprising:

a) a dorsal panel having a finger region;

b) a weight coupled to the finger region of the dorsal panel; and c) a palmar panel coupled to the dorsal panel and thereby forming a cavity therebetween, wherein the palmar panel includes a slick exterior surface that extends along four fingers of the palmar panel.

9. The glove of claim 8, wherein the finger region of the dorsal panel includes an array of four finger regions and the array of four finger regions has at least two weights coupled to each thereto in a longitudinally spaced relationship to each other.

10. The glove of claim 9, wherein the dorsal panel further includes: a thumb region spaced and orientated away from the finger region; and a weight coupled to the thumb region.

11. The glove of claim 10, wherein the at least two weights each include a sealed pocket including heavy grains.

12. The glove of claim 11, wherein the at least two weights are not selectably removable.

13. The glove of claim 12, further comprising a weighted sleeve extending proximally from a proximal end of the combined dorsal and palmar panels.

14. The glove of claim 13, wherein the slick exterior surface has a coefficient of friction smaller than about 80% of the coefficient of friction of wet hands.

15. A method of improving physical characteristics of an athlete using a glove, comprising the steps of:

a) providing the glove, comprising:

a1) a dorsal panel having a finger region;

a2) a weight coupled to the finger region of the dorsal panel; and a3) a palmar panel with a palmar array of four finger regions coupled to the dorsal panel and thereby forming a cavity therebetween, wherein the palmar panel includes a slick exterior surface that extends along the palmar array of four finger regions of the palmar panel; and b) performing an athletic exercise while wearing the glove, thereby improving one or more physical characteristics of the athlete.

16. The method of claim 15, wherein the finger region of the dorsal panel includes an array of four finger regions and the array of four finger regions has at least two weights coupled to each thereto in a longitudinally spaced relationship to each other; wherein the dorsal panel further includes: a thumb region spaced and orientated away from the finger region; and a weight coupled to the thumb region.

17. The method of claim 16, wherein the at least two weights each include a sealed pocket including heavy grains.

* * * * *